US007177805B1

(12) United States Patent
Oh et al.

(10) Patent No.: US 7,177,805 B1
(45) Date of Patent: Feb. 13, 2007

(54) SIMPLIFIED NOISE SUPPRESSION CIRCUIT

(75) Inventors: Stephen S. Oh, Palo Alto, CA (US); Ethan T. Davis, Minato-ku (JP)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/483,569

(22) Filed: Jan. 14, 2000

Related U.S. Application Data

(60) Provisional application No. 60/118,181, filed on Feb. 1, 1999.

(51) Int. Cl.
*G10L 19/14* (2006.01)

(52) U.S. Cl. ..... 704/225; 704/226

(58) Field of Classification Search ..... 704/226, 704/227, 225; 381/94.3; 379/392.01
See application file for complete search history.

(56) References Cited

U.S. PATENT DOCUMENTS 4,628,529 A * 12/1986 Borth et al. ..... 381/94.3
4,630,304 A * 12/1986 Borth et al. ..... 381/94.3
4,630,305 A * 12/1986 Borth et al. ..... 381/94.3
5,012,519 A * 4/1991 Adlersberg et al. ..... 704/226
5,706,395 A 1/1998 Arslan et al. ..... 395/2.35
6,070,137 A * 5/2000 Bloebaum et al. ..... 704/227
6,122,610 A * 9/2000 Isabelle ..... 704/226
6,144,937 A * 11/2000 Ali ..... 704/233
6,862,567 B1 * 3/2005 Gao ..... 704/228
6,898,290 B1 * 5/2005 Saunders et al. ..... 381/71.6

OTHER PUBLICATIONS

Oppenheim et al, "Discrete-Time Signal Processing", 1989, pp. 57,59,60,542,543,548).*

* cited by examiner

*Primary Examiner*—Michael N. Opsasnick
(74) *Attorney, Agent, or Firm*—Robert D. Marshall, Jr.; W. James Brady; Frederick J. Telecky, Jr.

(57) ABSTRACT

A system for reducing noise in an acoustical signal comprises a sampler (104) for obtaining discrete samples of the acoustical signal, an analog to digital converter (106), and a noise suppression circuit (108). The noise suppression circuit (108) selects a fixed number of samples. These samples are multiplied by a windowing function and the fast Fourier transform is computed to yield transformed windowed signals. A smoothed power estimate and a noise estimate are calculated. The noise estimate and the smoothed power estimate is used to calculate a gain function. A transformed speech signal is obtained by multiplying the gain function with the transformed windowed signal. Then, the inversed fast Fourier transform of the transformed speech signal is added to a portion of the speech signal of a previous frame.

6 Claims, 2 Drawing Sheets

SIMPLIFIED NOISE SUPPRESSION CIRCUIT

This application claims priority under 35 USC §119(e)(1) of Provisional Application No. 60/118,181, filed Feb. 1, 1999.

TECHNICAL FIELD OF THE INVENTION

This invention relates generally to electronic devices and more specifically to a simplified noise suppression circuit.

BACKGROUND OF THE INVENTION

As the market for digital cellular telephones increases the importance of noise suppression in speech processing also increases. Users of digital telephones expect high performance in noisy conditions such as operation in a moving automobile.

One common noise suppression technique is the well known spectral subtraction method. With this method, the noise signal, N(t) is considered to be stationary and independent of the received signal, X(t), such that:

$$X(t)=S(t)+N(t)$$

Where S(t) is noise-free speech signal.

Given the above equation, it is possible to calculate the power spectrum of the signal and subtract the noise spectrum. This is typically accomplished by sampling the input signal, estimating the power spectrum by applying the fast Fourier transform algorithm to the data sample, removing the noise component and then applying the inverse fast Fourier transform to recover the time domain clean speech signal.

This technique significantly increases the quality of the sampled speech but has the drawback of adding a distortion to the signal, often heard as a musical tone or noise.

To solve this problem, smoothed noise suppression techniques have been developed. An example of this technique is disclosed in U.S. Pat. No. 5,206,395, issued to Asslan, et al. and entitled "Adaptive Weiner Filtering Using a Dynamic Suppression Factor." This method improves spectral subtraction by clamping attenuation to limit suppression for input with small signal-to-noise ratios, by smoothing noisy speech and noisy spectral through use of a filter, by increasing noise estimates to avoid filter fluctuations, and by updating a noise spectrum estimate from the preceding frame using the noisy speech spectrum. This approach eliminates musical tones or noise but has the draw back of being computationally expensive.

SUMMARY OF THE INVENTION

In accordance with the present invention, a simplified noise suppression circuit is provided that substantially eliminate or reduce disadvantages and problems associated with previously developed suppression circuits. In particular, the simplified noise suppression circuit allows for noise reduction with less resources.

In one embodiment of the present invention a system for reducing noise in an acoustical signal is provided. The system comprises a sampler for obtaining discrete samples of the acoustical signal, an analog to digital converter coupled to the sampler and operable to convert the analog discrete samples into a digitized sample, and a noise suppression circuit coupled to the analog to digital converter. The noise suppression circuit reduces noise by first receiving the analog discrete samples and then selecting a fixed number of samples. These samples are multiplied by a windowing function and the fast Fourier transform of the windowed samples is computed to yield transformed windowed signals. Half of the transformed windowed signals are selected and a power estimate of the transformed windowed signals is calculated. Next, a smoothed power estimate is calculated by smoothing the power estimate over time and a noise estimate is calculated. The noise estimate and the smoothed power estimate are used to calculate a gain function. A transformed speech signal is obtained by multiplying the gain function with the transformed windowed signal. Then, the inversed fast Fourier transform of the transformed speech signal is calculated to yield a sampled speech signal and the sampled speech signal is added to a portion of the speech signal of a previous frame.

Technical advantages of the present invention include the ability to reduce noise in an acoustical signal in an efficient manner. In particular, the present invention utilizes smaller sample sizes and calculates a power estimation in a simplified manner. Therefore, calculation complexity is reduced as is the need for large buffers.

Other technical advantages will be readily apparent to one skilled in the art from the following figures, description, and claims.

BRIEF DESCRIPTION OF THE DRAWINGS

For a more complete understanding of the present invention and its advantages, reference is now made to the following description taken in conjunction with the accompanying drawings in which.

DETAILED DESCRIPTION OF THE INVENTION

Figure 1:
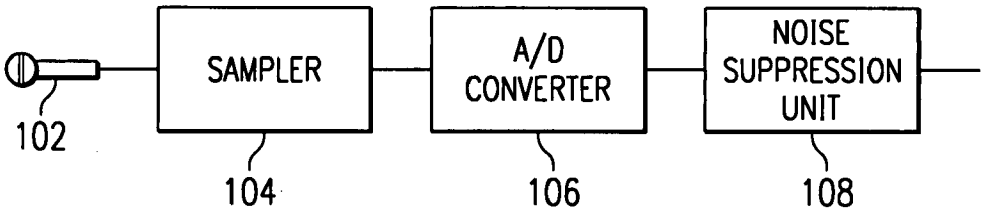
FIG. 1 illustrates a speech acquisition system in accordance with the teaching of the present invention.

FIG. 1 illustrates a speech acquisition system in accordance with the teaching of the present invention. Illustrated is a microphone 102 coupled to a sampler 104 which is then coupled to an analog-to-digital converter 106 which is coupled to a noise suppression unit 108. In operation, speech is picked up by microphone 102 and transmitted to sampler 104. Sampler 104 then takes discreet samples of that speech signal and transmits the samples to analog-to-digital converter 106. Analog-to-digital converter 106 converts the analog samples into digital samples. Sampler 104 and analog-to-digital converter 106 can be combined as one unit. The digital signal is then sent to noise suppression unit 108 where it is processed to remove the noise in accordance with the teaching of the present invention. After that, the noise reduced signal is transferred either to a transmitter in the case of a cellular phone, or for further processing.

Figure 2:
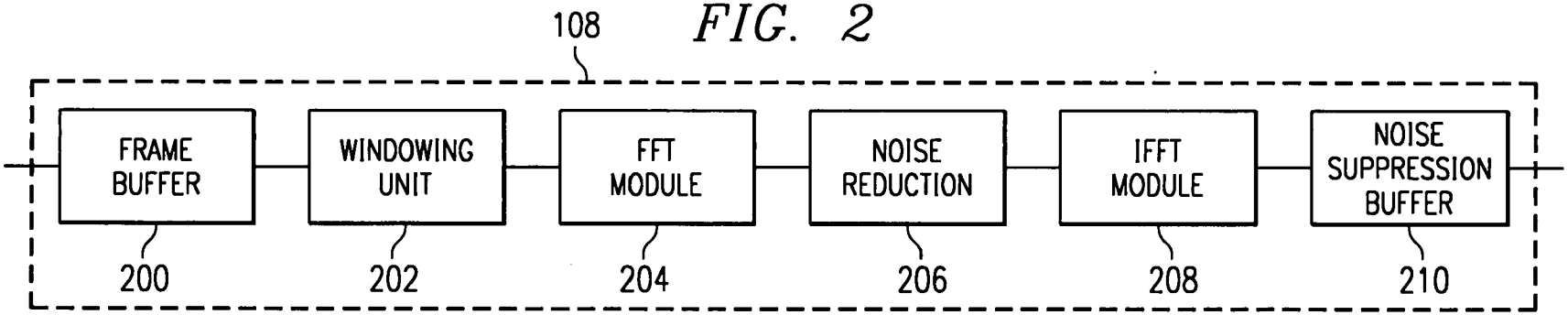
FIG. 2 illustrates a block diagram illustrating noise suppression unit in accordance with the teaching of the present invention; and, FIG. 3 is a flow chart illustrating the operation of the present invention.

FIG. 2 illustrates a block diagram illustrating noise suppression unit 108 in accordance with the teaching of the present invention. Illustrated is a frame buffer 200 coupled to a windowing unit 202 which is coupled to a fast Fourier transfer module 204 which is then coupled to a noise reduction algorithm unit 206 which is then coupled to a inverse fast Fourier transfer module 208 which is finally coupled to a noise suppression frame buffer 210. In operation, frame buffer 200 partitions speech samples into frames of 32 samples. The sample frames are then sent to the windowing module 202 or an appropriate window function is applied. In one embodiment a Hanning window is applied. Fast Fourier transfer module 204 converts the frames to the frequency domain by using the well-known fast Fourier transform. Noise reduction unit 206 then invokes the main noise reduction algorithm. Noise reduction unit 206 takes the first 16 samples and computes the absolute value of the power of the sample. Then that power value is smoothed using the following equation.

$$P^t(i)=(1-\propto)P^{t-1}(i)+\propto P(i)$$

A noise estimate is then updated and the gain function is computed using the updated noise function and the smooth window function. The computed gain function is then multiplied by the speech sample and that is repeated for the first sixteen samples of a thirty-two sample window. Inverse fast Fourier transfer unit 208 then takes the inverse fast Fourier transfer form of the output of noise reduction unit 206. Also, those sixteen samples are then added to the sixteen samples of the previous frame. The output of inverse fast Fourier transfer unit 208 is to the noise suppression frame buffer 210 which holds the noise reduced output for either further analysis or transmission. Although FIG. 2 illustrates each step of the noise reduction occurring in different blocks, it is well known that one or more blocks can be combined to perform functions at the same time. Also, all the noise suppression computations may be performed with a standard digital signal processor such as a TMS320C5X or TMS320C54X, manufactured by Texas Instruments.

In one embodiment, noise suppression uses fast Fourier transform. However, it is also known that instead of the use of fast Fourier transforms, functions can be convoluted instead.

Figure 3:
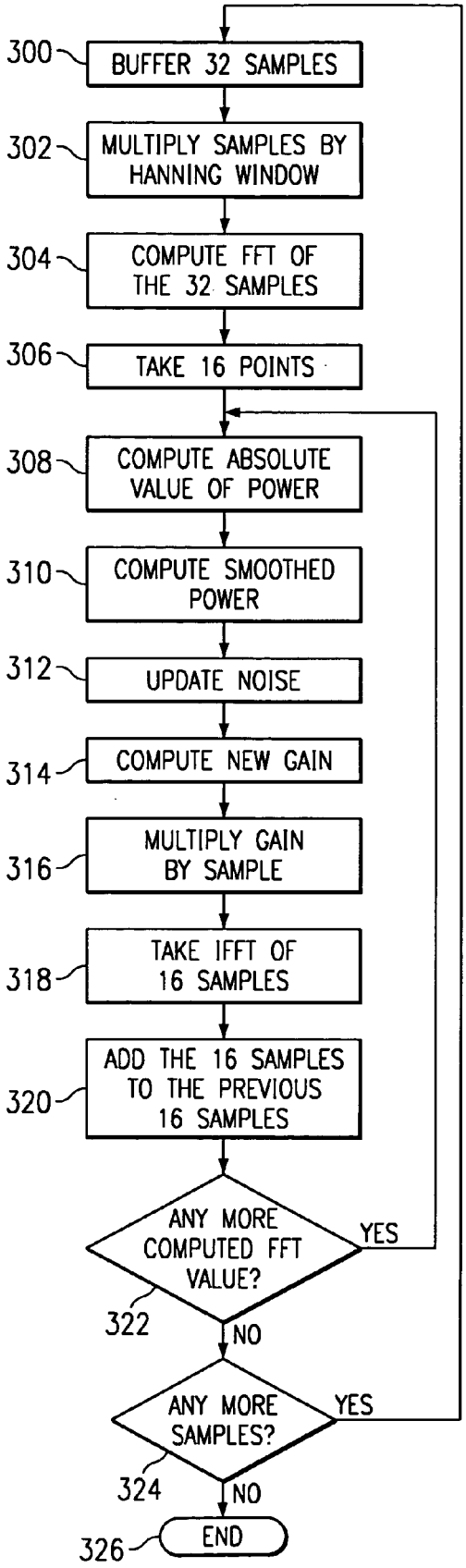

FIG. 3 is a flow chart illustrating the operation of the present invention. In step 300, 32 samples are received at a buffer. The present invention utilizes a small number of samples at a time, such as 32, to allow for the use of smaller buffers as well as decreasing, the buffer latency. While 32 samples are discussed in the example, it is well known in the art that other sample sizes can be used. The buffer is storing the sample signal which is of the form:

$$X(i)=S(i)+N(i)$$

When S(i) is the speech component of the signal and N(i) is the noise component.

In step 302, the samples are multiplied by a Hanning window. A Hanning window is of the form.

$$w(n) = 0.5 - .05\cos\left(\frac{2n}{m}\right)$$

otherwise $0 \leqq n \leqq m$

Multiplying by the well known Hanning window is done to reduce the distortion effects of discrete time block processing.

In step 304, the fast Fourier transform of the 32 points is calculated. Then, the first sixteen values are selected and the absolute power, Pi, of those values is calculated in step 308 to $$Pi=|x(i)|'$$

$$\text{where } |X(i)|'=|x_r(i)|'+|x_i(i)|'$$

Computational complexity is reduced by calculating the absolute value of the signal as opposed to the square to calculate power. After that is accomplished, the power estimate is smoothed over a time index (as opposed to a spectral smoothing as is used in the spectral subtraction method) in step 310. The smoothed value is calculated using the following equation:

$$P^t(i)=(1-\propto)P^{t-1}(i)+\propto P(i)$$

Where $\propto$ is a predetermined value called the smoothing factor and is chosen experimentally by study of the dynamic nature of the subject noise to be filtered out. The noise estimate, $|N^n(i)|$ is updated in step 312 by an artificial increase of the noise spectral estimate by a small margin, such as 5 dB/second. The noise estimation is calculated after the smoothed power value is calculated. It is calculated as follows:

$$\text{if } p^t(i)>\text{upconst}*(n^{n-1}(i))$$

$$\text{then } n^n(i)=\text{downconst}*(n^{n-1}(i)).$$

Upconst is a factor chosen to limit the increase in noise estimated adaptation to 3 Db/sec. Basically, the above equation states that if the new smoothed power estimate is greater than the last noise estimate, then the new noise estimate is the last noise estimate increased by a factor.

$$\text{If } p^t(i)<(\text{downconst})*(n^{n-1}(i))$$

$$\text{then } |n^n(i)|=\text{downconst}*(n^{n-1}(i)).$$

Downconst is a constant chosen to limit the decrease in noise estimate adaption to about −12 Db/sec. This equation states that if the smoothed power estimate is less than the last noise estimate, the new noise estimate is the old estimate decreased by the downcast factor. Otherwise, $p^t(i)=n^n(i)$. The new noise estimate equates the new smoothed power value.

This serves the purpose of limiting large fluctuations in attenuation resulting from small errors in the noise estimator.

Now that the noise spectrum is calculated the gain can be calculated in step 316. Earlier it was noted that the incoming signal was of the form:

$$X(t)=S(t)+N(t)$$

In terms of the absolute value the equation can be come:

$$|X(i)|'=|S(i)|'+|N(i)|'$$

Where again each term represents the absolute value of its real and imaginary part. Solving for the speech component:

$$|S(i)|'=|X(i)|'-|N(i)|'$$

$$|S(i)|' = \left(1 - \frac{|N(i)|'}{|X(i)|'}\right)\cdot|X(i)|'$$

and we define the gain function as:

$$G(i) = 1 - \frac{|N(i)|'}{|X(i)|'}$$

However, earlier it was shown that $$P(i)=|x(i)|'$$

and after smoothing:

$$P(i)=P^t(i)$$

Therefore, the gain is:

$$G(i) = 1 - \gamma\frac{|N^n(i)|}{P^t(i)}$$

Where γ is a predetermined parameter described as an artificial increase of the noise spectral estimator.

In step 316, once the gain is calculated the speech signal can be found by multiplying the sampled values by the gain:

$$S(t)=G(i)*X(i)$$

In step 318, the inverse fast Fourier transfer is taken and in step 320, the sixteen computed values are added to the previous sixteen values. Then, in decision block 322 it is determined if there are any more already computed fast Fourier transition results awaiting calculation. If yes, the next 16 values are then calculated as before starting at step 308. If there are no more already calculated fast Fourier transfer value, decision box 324 is reached. In that box, it is determined it there is any more samples to solve. If no, then the method ends at step 326. If there are more samples, execution continues at step 300.

Instead of using the absolute value to estimate the powers, actual power could be calculated using the square of the samples, i.e., $$P(i)=|X(i)|^2$$

In this case the gain constant would be:

$$G(i) = 1 + \lambda + \gamma\frac{|N^n(i)|^2}{P^{\infty}(i)}$$

where λ and γ are predetermined constants.

This simplified spectral subtraction yields a speech signal with quality as good as the traditional spectral speech algorithm but one that has smaller memory requirement and reduced computational burden.

Although the present invention has been described using several embodiments, various changes and modifications may be suggested to one skilled in the art after a review of this description. It is intended that the present invention encompass such changes and modifications as fall within the scope of the appended claims.

What is claimed is:

1. A method for reducing noise in a sampled acoustic signal, comprising:

receiving a stream of sampled acoustic signals;

digitizing each sampled acoustic signal thereby forming digital samples;

selecting a fixed number of digital samples;

multiplying the digital samples by a windowing function;

computing the fast Fourier transform of the selected windowed digital samples to yield transformed windowed signals;

selecting half of the transformed windowed signals;

calculating a power estimate of the transformed windowed signals;

calculating a smoothed power estimate by smoothing the power estimate over time using the equation:

$$P^t(i)=(1-a)P^{t-1}(i)+aP(i)$$

where: $P^t(i)$ is the smoothed power estimate for a current time sample to be calculated for the i-th FFT point; $P^{t-1}(i)$ is the smoothed power estimate for an immediately prior time sample for the i-th FFT point; P(i) is the calculated power estimate of the transformed windowed signals for the i-th FFT point; and a is an experimentally chosen pre determined value called the smoothing factor;

calculating a noise estimate;

calculating a gain function from the noise estimate and the smoothed power estimate;

calculating a transformed speech signal by multiplying the gain function with the transformed windowed signal;

calculating an inversed fast Fourier transform of the transformed speech signal to yield a sampled speech signal; and adding the sampled speech signal to a portion of the speech signal of a previous frame.

2. The method of claim 1, wherein the fixed number of samples is thirty-two.

3. The method of claim 1, wherein the windowing function is a hanning window function.

4. A system for reducing noise in an acoustical signal comprising:

a sampler for obtaining discrete samples of the acoustical signal;

an analog to digital converter coupled to the sampler an operable to convert the analog discrete samples into a digitized sample;

a noise suppression circuit coupled to the analog to digital converter and operable to:

receive the digitized samples;

select a fixed number of digitized samples;

multiply the digitized samples by a windowing function;

compute the fast Fourier transform of the windowed digitized samples to yield transformed windowed signals;

select half of the transformed windowed signals;

calculate a power estimate of the transformed windowed signals;

calculate a smoothed power estimate by smoothing the power estimate over time using the equation:

$$P^t(i)=(1-a)P^{t-1}(i)+aP(i)$$

where: $P^t(i)$ is the smoothed power estimate for a current time sample to be calculated for the i-th FFT point; $P^{t-1}(i)$ is the smoothed power estimate for an immediately prior time sample for the i-th FFT point; P(i) is the calculated power estimate of the transformed windowed signals for the i-th FFT point; and a is an experimentally chosen predetermined value called the smoothing factor;

calculate a noise estimate;

calculate a gain function from the noise estimate and the smoothed power estimate;

calculate a transformed speech signal by multiplying the gain function with the transformed windowed signal;

calculate an inversed fast Fourier transform of the transformed speech signal to yield a sampled speech signal; and add the sampled speech signal to a portion of the speech signal of a previous frame.

5. The system of claim 4, wherein the fixed number of samples is thirty-two.

6. The system of claim 4, wherein the windowing function is a hanning window function.

* * * * *